United States Patent [19]

Cirella

[11] 4,337,806

[45] Jul. 6, 1982

[54] LIQUID DISPENSING DEVICE

[76] Inventor: Dominc Cirella, 139 Wentworth North, Hamilton, Ontario, Canada, L8L 5V6

[21] Appl. No.: 181,739

[22] Filed: Aug. 26, 1980

[51] Int. Cl.[3] ..... B65B 3/04; B67C 3/00

[52] U.S. Cl. ..... 141/286; 141/100; 141/301

[58] Field of Search ..... 141/285–310, 141/34, 100, 9, 31, 363, 364, 365, 366

[56] References Cited

U.S. PATENT DOCUMENTS 2,550,589 4/1951 Orme ..... 141/286

*Primary Examiner*—Richard R. Stearns

*Attorney, Agent, or Firm*—Fleit & Jacobson

[57] ABSTRACT

A device for floating liquid from a container onto a base layer formed of another liquid. The device comprises a connector attachable to the container to pass liquid from the container. The device also includes a tubular member having an upper end attached to the connector to receive the liquid passing from the container and a lower end having at least one aperture from which the liquid can escape. A cap is attached to the tubular member lower end. The cap has internal surfaces defining a well disposed about and rising above the apertures so that all the escaping liquid is constrained to rise vertically out of the well. The cap has external surfaces immersible in the base layer to permit the liquid rising out of the well to flow over the external surfaces onto the base layer.

4 Claims, 4 Drawing Figures

LIQUID DISPENSING DEVICE

The invention relates to a device for making multi-layered drinks and more particularly to a device for floating liquid from a container onto a base layer formed of another liquid.

Multi-layered drinks comprising several distinct layers of different alcoholic beverages, and possibly some layers of non-alcoholic beverages, are quite well known. In the past, a bartender might prepare such a drink by pouring a first layer of liquid into a glass and then gently pouring succeeding layers of lighter liquors, generally having a higher alcoholic content and consequently a lower specific gravity, along a stir rod onto the preceding layers. During this process the stir rod might be held inclined with a lower end contacting the inside surfaces of the glass just above the preceding layers. The liquor poured over the rod would then hopefully disperse along the inside surfaces of the glass and descend gently onto the preceding layers. Regardless of the technique used to pour the multi-layered drinks, care had to be taken to avoid any turbulence which might cause the layers to mix.

The invention provides a device for floating liquid from a container onto a base layer formed of another liquid. The container might be, for example, a conventional liquor bottle. The device includes a connector attachable to the container to pass liquid from the container. The device also includes a tubular member having an upper end attached to the connector to receive the liquid passing from the container and a lower end having at least one aperture from which the liquid can escape. A cap is attached to the tubular member lower end. The cap has internal surfaces defining a well disposed about and rising above the apertures so that the escaping liquid is constrained to rise vertically out of a well. This welling effect tends to reduce the turbulence which might otherwise occur if the liquid were to flow freely from the apertures. The cap has external surfaces which are immersible in the base layer to permit the liquid rising out of the well to flow over the external surfaces onto the base layer.

Embodiments of the invention will now be described by way of example only with reference to the accompanying drawings in which.

Figure 1:
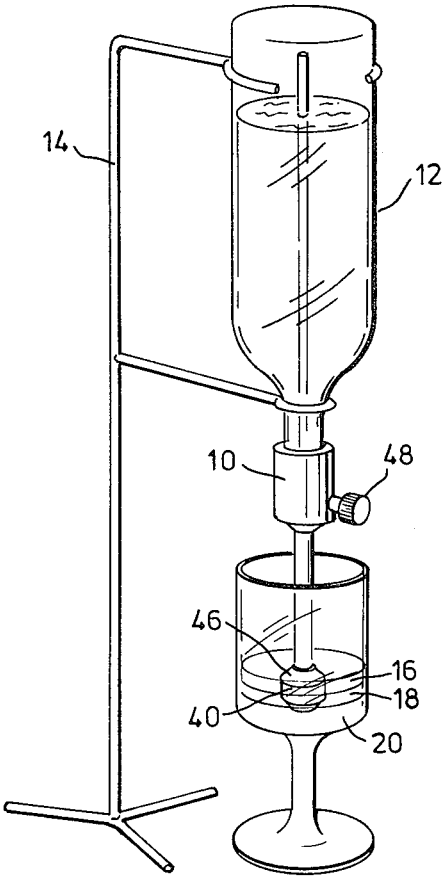
FIG. 1 is a perspective view of a dispenser constructed being used to make a multi-layered drink.

Reference is made to FIG. 1 which illustrates a dispenser 10, attached to a bottle of liquor 12 which is in turn suspended from a stand 14. The dispenser is shown being used to pour a layer 16 of the liquor onto two preceding layers 18, 20 of different liquors contained in a glass 22.

Figure 2:
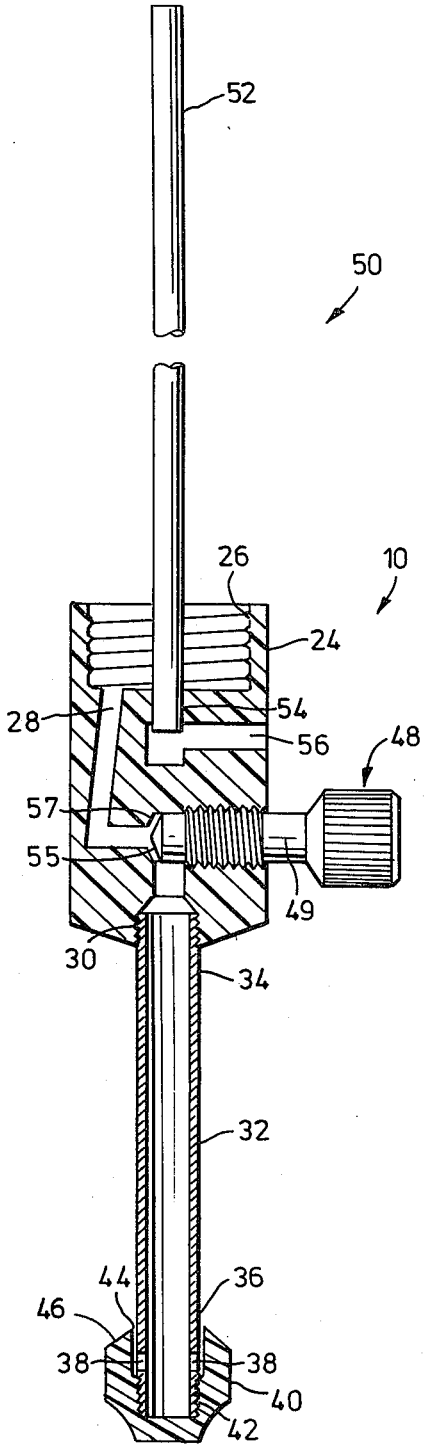
FIG. 2 is a cross-sectional view of the dispenser in FIG. 1.

The dispenser 10 is better illustrated in the cross-sectional view of FIG. 2. The dispenser 10 includes a connector 24 to attach the dispenser 10 to the bottle 12 by means of an internal thread 26. The connector 24 can therefore be screwed onto a conforming external thread (not shown) located on the bottle 12. A passageway 28 having a threaded lower end portion 30 permits the flow of liquor from the bottle 12 through the connector 24.

A threaded upper end 34 of tubular member 32 is received in the lower end portion 30 so that the interior of the tubular member is connected to the passageway 28. A pair of apertures 38 are provided at a lower end 36 of the member 32 to permit the liquor to escape from the interior of the tubular member 32.

A cap 40 having an internal threaded portion 42 is screwed onto a threaded portion of the lower end 36 of the tubular member 32 to seal the lower end of the tubular member 32. The cap 40 has internal surfaces defining a well 44 disposed about and rising above the apertures 38 so that the liquid passing through the apertures 38 is constrained to rise vertically out of the well 44. The cap 40 has external surfaces 46 substantially uniformly inclined at an angle slightly less than 45° to horizontal. The external surfaces 46 are immersible, for example, in the layer 18 of FIG. 1 to permit the liquor rising out of the well 44 to flow smoothly onto the layer 18.

A valve 18 is located in the passageway 28 to regulate the rate of flow of liquor from the bottle 12 and consequently the rate at which the liquor rises out of the well 44. The valve 48 includes a rotatable plug 49 with a threaded external surface 51. The surface 51 engages a complimentary thread 53 within the connector 24 so that rotation of the plug 49 causes a displacement of the plug relative to the connector 24. A conical head 55 is formed at one end of the plug 24 and is engageble with a seat 57 provided in the passageway 28. The clearance between the seat 57 and the head 55 may be adjusted by rotation of the plug 49 to determine the flow rate through the passage.

The connector is also provided with a vent 50 which permits air into the bottle 12 as the liquor is displaced. The vent 50 comprises a stainless steel tube 52 intended to run substantially the internal length of the bottle 12 and adhesively mounted at 54 in a passageway 56 that is open to the air. The passageway 56 is sealed at 54 by the adhesive to prevent seepage of liquor into the passageway 56.

The operation of the dispenser will now be described. A glass 22 already containing layers 18, 20 is raised up to the cap 40 until the external surfaces 46 are partially immersed in the layer 18. The valve 48 is then opened to move the head 55 away from the seat 57 and to permit liquor to flow from the bottle through the passage 28 and tubular member 32. The liquor will then flow through the apertures 38, into the well 44 and down the external surfaces 46 onto the layer 18. As the layer 16 grows, the glass 22 is preferably displaced downwardly with respect to the cap 40 so that the surfaces 46 are further removed from preceding layers 18, 20. The fine control provided by the valve 48 and the gentle flow of liquor over the surfaces 46 reduces the turbulance of the layer 18 to enhance the separation of the layers 16, 18. Once the layer 16 has been laid, liquor can be allowed to well more quickly into the layer 16 with less likelihood of the layers 16, 18, 20 being mixed. It will be appreciated that to make a multilayered drink the dispenser 10 may be interchanged among a number of bottles of liquor or the dispenser 10 may be provided for each bottle.

Figure 3:
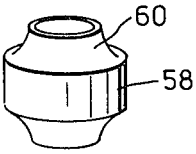
FIG. 3 is a perspective view of an alternative embodiment of a cap suitable for use with the dispenser of FIG. 1; and, FIG. 4 is an alternative embodiment utilising a measured dispenser.

FIG. 3 illustrates a further embodiment of a cap 58 which is similar in construction to the cap 40 of FIG. 2 except that the external surfaces 46 have been replaced by concave surfaces 60. The concave surfaces 60 tend to direct liquor rising out of the cap 58 substantially horizontally over the base layers 18, 20 thereby reducing vertical movement which might tend to cause layer 16, 18, 20 to mix.

Figure 4:
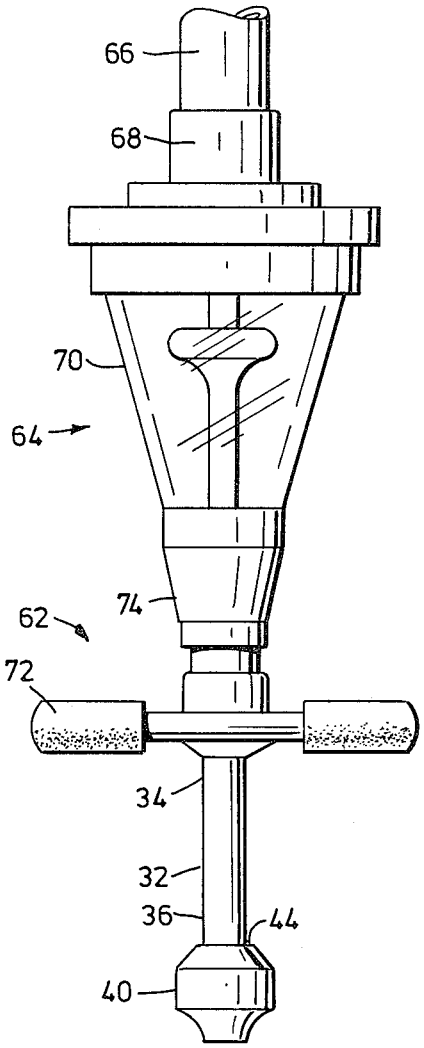

FIG. 4 illustrates a dispenser 62 which is arranged to dispense a measured quantity of liquor. Like reference numerals have been used to indicate components common to the dispenser 10, 62 with a suffix "a" for clarity of description.

The connector 64 is a conventional bar device that measures the delivers one ounce portions of liquor or the like and replaces the connector 24 and valve 48 in the embodiment of FIG. 1. The outlet from the connector 64 is attached to a tubular member 32*a* having an end cap 40*a*. The connector 64 includes a tubular end portion 66 surrounded by a cork stopper 68 which serves to attach the device 62 to a container such as the bottle 12 above. Once attached, the air in chamber 70 is displaced upwardly by liquor passing through the tubular end portion 66. When a handle 72 is raised, the tubular end portion 66 is blocked by a piston 73 to prevent further liquor from flowing into the chamber 70. The liquor in the cavity is permitted to flow through and out an end portion 74 into the tubular member 32*a* and onto the layer a liquor in the glass. When the handle 72 is lowered, the cavity 70 once again fills with liquor. In this manner, the connector 64 serves to deliver a fixed volume of liquor which then wells from the cap 40 to be used in making layered drinks.

The embodiments of the invention in which an exclusive property or privilege is claimed are defined as follows:

1. A device for floating liquid from a container onto a base layer formed of another liquid, comprising:

a connector attachable to the container to pass liquid from the container;

a tubular member having an upper end attached to the connector to receive the liquid passing from the container and a lower end having at least one aperture from which the liquid can escape; and, a cap attached to the tubular member lower end, the cap having internal surfaces defining a well disposed about and rising above the apertures so that escaping liquid is constrained to rise vertically out of the well, the cap having external surfaces which are immersible in the base layer to permit the liquid rising out of the well to flow over the external surfaces onto the base layer, wherein one of the connector and tubular member including means for regulating the flow of the liquid from the container.

2. A device as claimed in claim 1 in which the connector includes a vent permitting air to displace the liquid flowing from the container.

3. A device as claimed in claim 1 wherein said external surfaces are adjacent to the top of the well and substantially uniformly inclined at an angle not exceeding 45 degrees relative to horizontal.

4. A device as claimed in claim 1 in which the cap external surfaces adjacent to the top of the well are concave so that the liquid rising out of the well is directed substantially horizontally over the base layer.

* * * * *